US008555990B2

(12) United States Patent
Ver Steeg et al.

(10) Patent No.: US 8,555,990 B2
(45) Date of Patent: Oct. 15, 2013

(54) INTEGRATED PUMPER APPARATUS

(75) Inventors: David A. Ver Steeg, Sioux Falls, SD (US); Paul D. Cressman, Brandon, SD (US)

(73) Assignee: Spartan Motors, Inc., Charlotte, MI (US)

( * ) Notice: Subject to any disclaimer, the term of this patent is extended or adjusted under 35 U.S.C. 154(b) by 191 days.

(21) Appl. No.: 13/090,558

(22) Filed: Apr. 20, 2011

(65) Prior Publication Data

US 2011/0259614 A1 Oct. 27, 2011

Related U.S. Application Data

(60) Provisional application No. 61/326,262, filed on Apr. 21, 2010.

(51) Int. Cl.
*A62C 27/00* (2006.01)

(52) U.S. Cl.
USPC ..... 169/24; 169/13; 169/52; 239/172; 280/838; 296/37.6

(58) Field of Classification Search
USPC ..... 169/5, 9, 13–16, 24, 52, 54; 239/172; 180/14.2; 280/838; 296/37.1, 37.6
See application file for complete search history.

(56) References Cited

U.S. PATENT DOCUMENTS

| | | | | |
|---|---|---|---|---|
| 2,209,666 | A | 7/1940 | Sheppard | |
| 4,157,733 | A | 6/1979 | Ewers et al. | |
| 7,234,534 | B2 | 6/2007 | Froland et al. | |
| 7,530,403 | B2 * | 5/2009 | Cano | 169/24 |
| 7,784,554 | B2 | 8/2010 | Grady et al. | |
| 7,987,916 | B2 * | 8/2011 | Laskaris et al. | 169/24 |

* cited by examiner

*Primary Examiner* — Steven J Ganey

(74) *Attorney, Agent, or Firm* — Reinhart Boerner Van Deuren P.C.

(57) ABSTRACT

A fire-fighting pumper vehicle that includes a cab configured to transport a crew of firefighters, a water tank disposed to the rear of the cab, and a chassis configured to support the cab, the water tank, and one or more fire pump systems disposed on the chassis proximate to, and forward of, the rear wheels. In some embodiments, the fire pump system includes a power take-off pump, which is configured to operate a water only system or a compressed-air foam system from a gear case of the fire pump. The fire pump system includes nested components and is located and configured to occupy less space than conventional fire pump systems.

18 Claims, 8 Drawing Sheets

INTEGRATED PUMPER APPARATUS

CROSS-REFERENCE TO RELATED PATENT APPLICATIONS

This patent application claims the benefit of U.S. Provisional Patent Application No. 61/326,262, filed Apr. 21, 2010, the entire teachings and disclosure of which are incorporated herein by reference thereto.

FIELD OF THE INVENTION

This invention generally relates to fire-fighting equipment, and more particularly to fire-fighting equipment for a pumper vehicle.

BACKGROUND OF THE INVENTION

Traditionally, it has been the case in the fire-fighting industry that, for each type of emergency event, a specific vehicle has been designed that is adapted to respond to, and support fire-fighters in responding to, that type of emergency event. For example, when a structure catches on fire, the fire department would traditionally require a strictly pumper-style fire-fighting vehicle, while a car accident would require a different rescue-style vehicle.

In each case, custom, or tradition, has driven the need for multiple specialized vehicles to respond in emergency situations. It has been found that in many emergency response situations, the fire department may actually engage the pump on a fire-fighting vehicle, or pumper, only 5-8% of the time for a true fire-extinguishing need. Further, it is often the case that a single emergency situation may require several different types of emergency response vehicles. However, this can make responding to emergencies a very costly endeavor, especially for communities with small populations or limited resources. Thus, there is a need for a specialized type of pumper vehicle which is also configured to respond to other types of emergency situations to reduce the need for multiple specialized vehicles on a scene, thereby reducing operational costs, both in terms of equipment and personnel.

Embodiments of the invention provides such a specialized type of pumper. These and other advantages of the invention, as well as additional inventive features, will be apparent from the description of the invention provided herein.

BRIEF SUMMARY OF THE INVENTION

In one aspect, embodiments of the invention provide a fire-fighting pumper vehicle that includes a cab configured to transport a crew of firefighters, a water tank disposed to the rear of the cab, and a chassis configured to support the cab, the water tank, and one or more fire pumps disposed on the chassis proximate to, and forward of, the rear wheels. In some embodiments, the fire pump is a power take-off pump, which is configured to operate a compressed-air foam system from a gear case of the fire pump.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
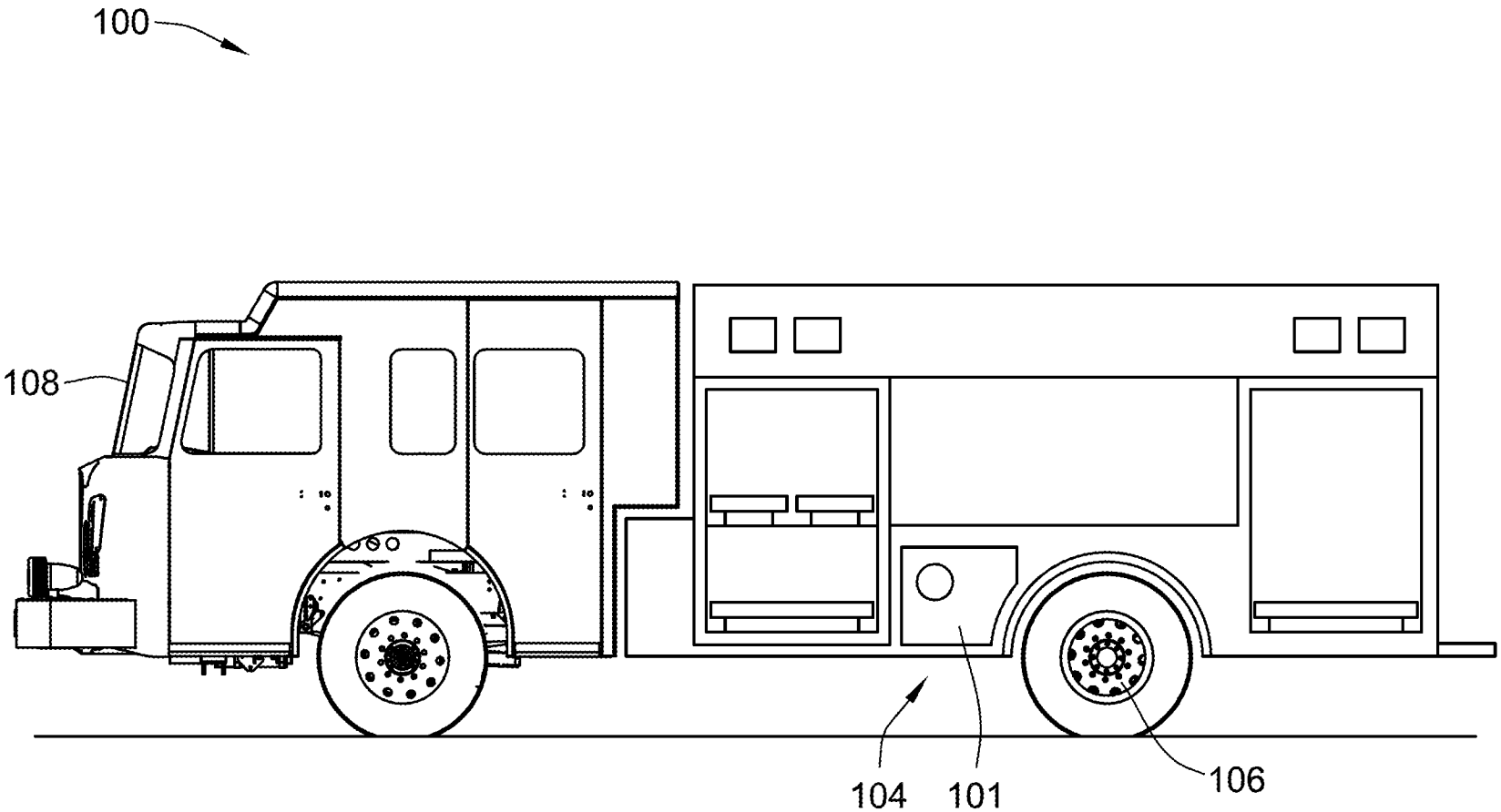
FIG. 1 is a plan view of a pumper vehicle with a fire pump and accessory system, constructed in accordance with an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Embodiments of the invention are described primarily in terms of its use on what has historically been termed a Class A pumper. Such a pumper is designed to meet the requirements set forth in NFPA 1901. Among the many requirements of NFPA 1901 is a requirement that the pumper have one or more water tanks with a total capacity of at least 300 gallons, and includes a fire pump with a minimum rated capacity of 750 gallons per minute (gpm). Further, for any pump rated at equal to or less than 2500 gpm, the pump must be able to supply 100% or rated pump capacity at 150 psi, 70% of rated capacity at 200 psi, and 50% of rated capacity at 250 psi. It is contemplated that embodiments of this invention includes a pumper vehicle with a fire pump having a rated capacity of up to approximately 1500 gpm, but is not limited to such.

Additionally, under NFPA 1901, pumpers are required to have a minimum of 40 cubic feet of storage for tools and equipment, and a minimum hose storage area of 30 cubic feet for 2.5-inch or larger fire hose, and two areas of at least 3.5 cubic feet to accommodate 1.5 in. or larger pre-connected fire hose. In addition to a cab for transporting a crew of firefighters, an array of ladders, nozzles, tools, axes, medical equipment, fire extinguishers, and self-contained breathing units, a fully-equipped pumper carries 800 feet of 2.5-inch or larger fire hose, 400 feet of 1.5-inch-2-inch fire hose, and a minimum of 20 feet of suction hose or 15 feet of supply hose.

Because pumpers are required to carry so much equipment, pumper configurations that provide more space for storage of such equipment are highly valued. An embodiment of the present invention is shown in FIG. 1, which illustrates a pumper 100 constructed to provide for better integration of the fire pump and accessory system 101 and vehicle. In an embodiment of the invention, a pumper 100, shown in FIG. 1, includes a fire pump and accessory system 101 that is positioned in a location 104 just forward of the rear wheel 106 and suspension. In a particular embodiment, the fire pump and accessory system 101 is positioned off the outside of the rails 132 (shown in FIGS. 4 and 5) and nested in a method that allows the gear case and pump body to be packaged together as efficiently as feasible.

Figure 2:
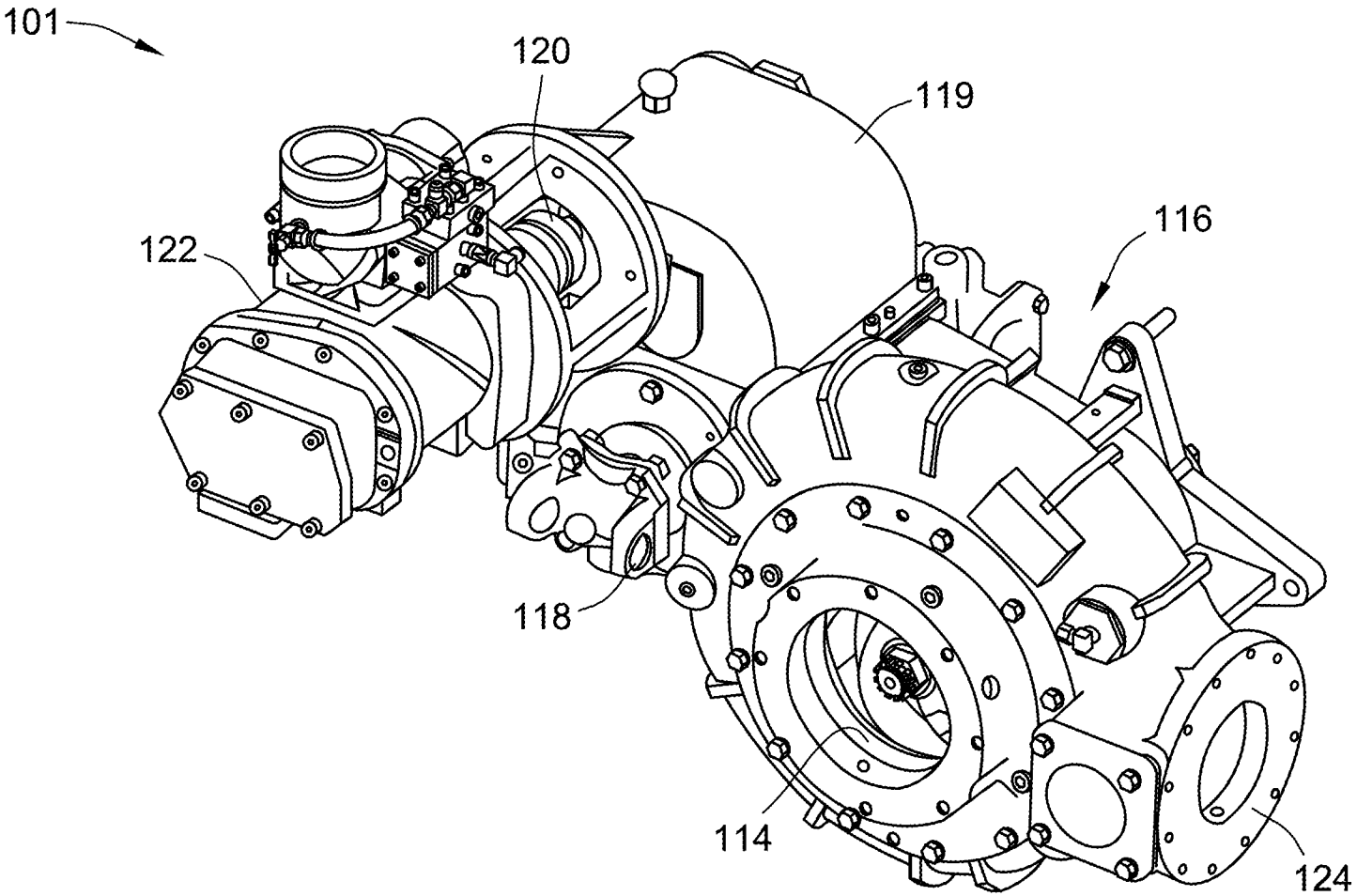
FIG. 2 is a pictorial view of a fire pump and accessory system, constructed in accordance with an embodiment of the invention.

FIG. 2 is a pictorial view of a fire pump and accessory system 101, constructed in accordance with an embodiment of the invention. The fire pump and accessory system 101 includes a pump suction inlet 114 through which water. The suction inlet 114 is in fluid communication with the pump impeller (not shown). The gear box 116 is coupled to the pump impeller and to a gear case 119, which is coupled to a gear case drive yoke 118. In a particular embodiment, the gear case drive yoke 118 is configured to be driven by a power takeoff device coupled to the engine of the pumper vehicle, for example. The gear case drive yoke 118 is coupled to drive output 120. The fire pump and accessory system 101 of FIG. 2 also includes and optional add-on compressed-air-foam-system (CAFS) compressor 122 coupled to the drive output 120, and a pump outlet 124 projecting transversely to suction inlet 114.

Figure 3:
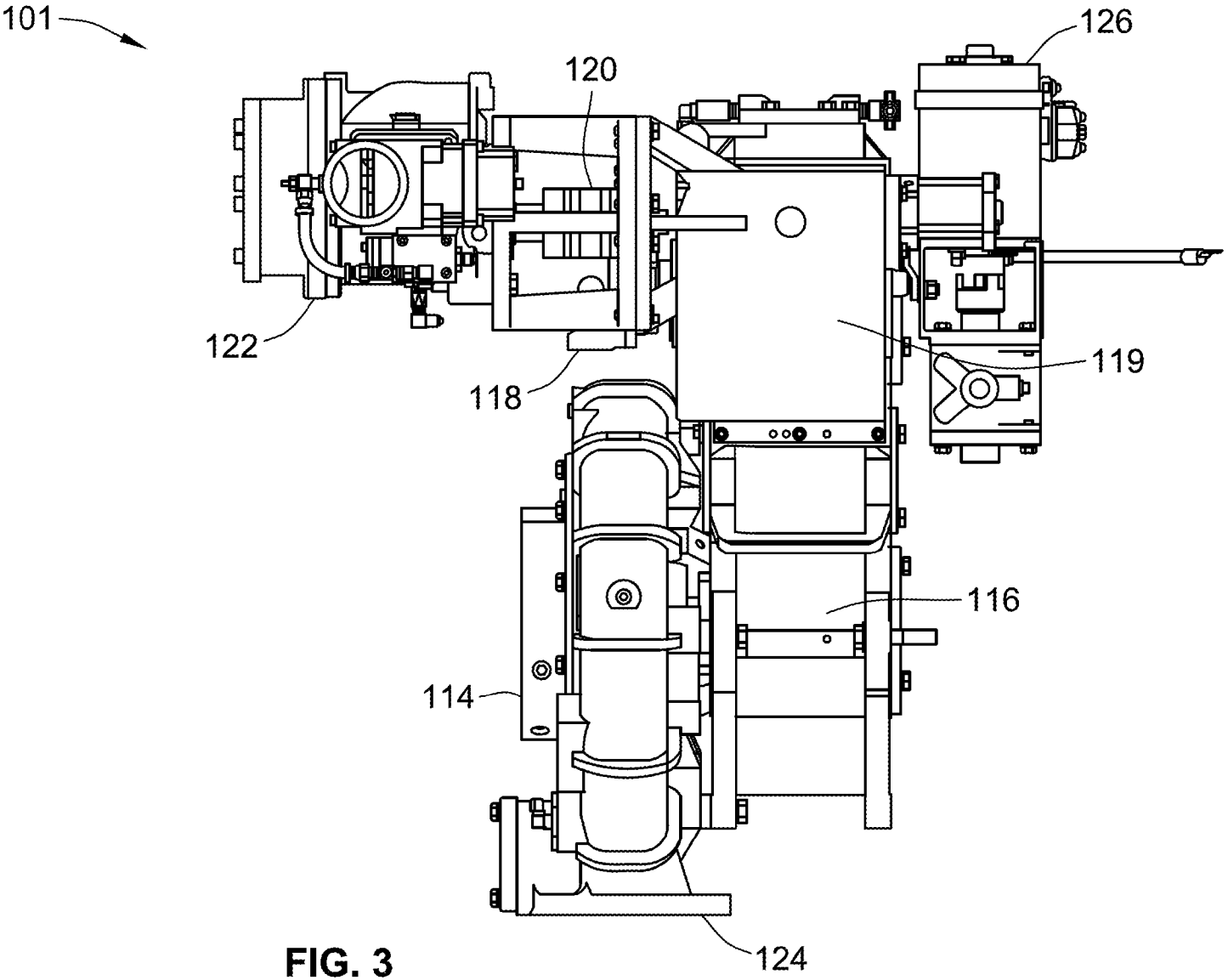
FIG. 3 is a top view of the fire pump and accessory system of FIG. 2.

FIG. 3 shows a top view of the fire pump and accessory system 101 of FIG. 2 which further includes an optional pump primer motor 126. The optional pump primer motor 126 is coupled to the gear case drive yoke 118. Before operation, the pump primer motor 126 ensures that the fire pump is fully flooded with water. Flooding the fire pump removes air from inside the suction and discharge casings of the fire pump, thus lowering the pressure inside these casings to below atmospheric pressure. Under these conditions, atmospheric pressure on a static water supply (e.g., even one at a lower level than the fire pump) is sufficient to move water through the pump. The pump impeller (not shown) can then create a vacuum in this low-pressure area that allows for a continuous flow of water through the fire pump.

In a conventional pumper, a power take-off (PTO) pump is typically located directly behind the cab 108, off of the side of the rail and nested down low, thus reducing the ramp break over angle of the vehicle. In the pumper 100 of FIG. 1, the ramp break over angle is increased due to the improved location 104 near the rear wheels 106. Break over angle is determined by the lowest point of the vehicle that is located when two tangent lines are drawn from each front wheel 121 (shown in FIG. 4) and rear wheel 106 to one common point 123 (shown in FIG. 4) on the underside of the vehicle 100.

Figure 4:
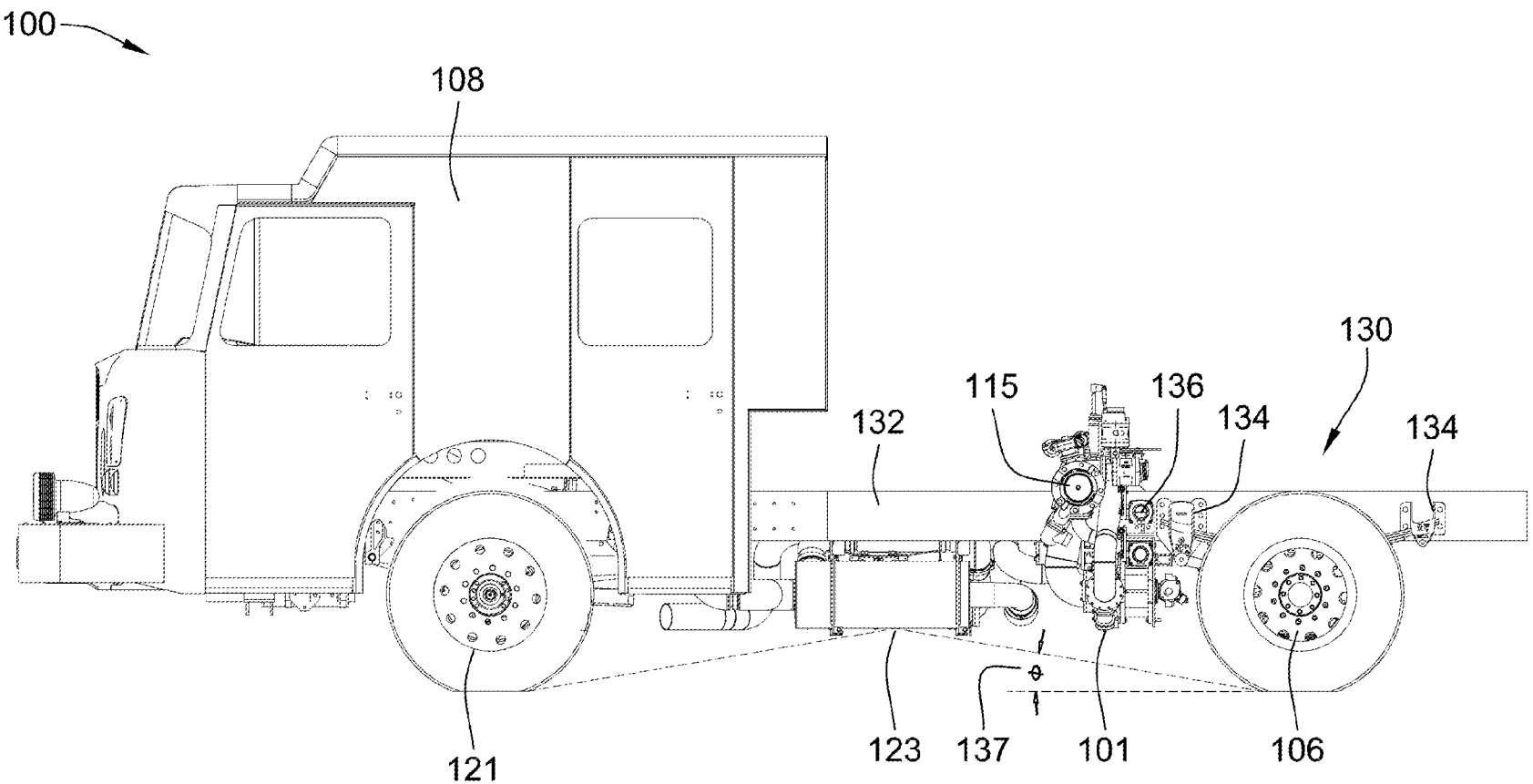
FIG. 4 is a side view of a pumper cab and chassis with a fire pump and accessory system, constructed in accordance with an embodiment of the invention.

FIG. 4 is a side view of a pumper vehicle 100 showing the cab 108 and the fire pump and accessory system 101 located on chassis frame 130. The chassis frame 130 has a pair of substantially parallel rails 132 and rear chassis suspension components 134. Thus, in a conventional pumper having a PTO fire pump located behind the cab 108, the pump is typically positioned low and off to the side of the frame, such that the pump becomes your low point. By positioning the pump closer to the rear wheel 106, a break over angle 136 is increased as the fire pump is positioned farther from the intersecting midpoint of these two tangent lines. Therefore, the break over angle 136 in the pumper 100 of FIG. 1 is typically higher when compared to the break over angle in conventional pumpers.

Figure 5:
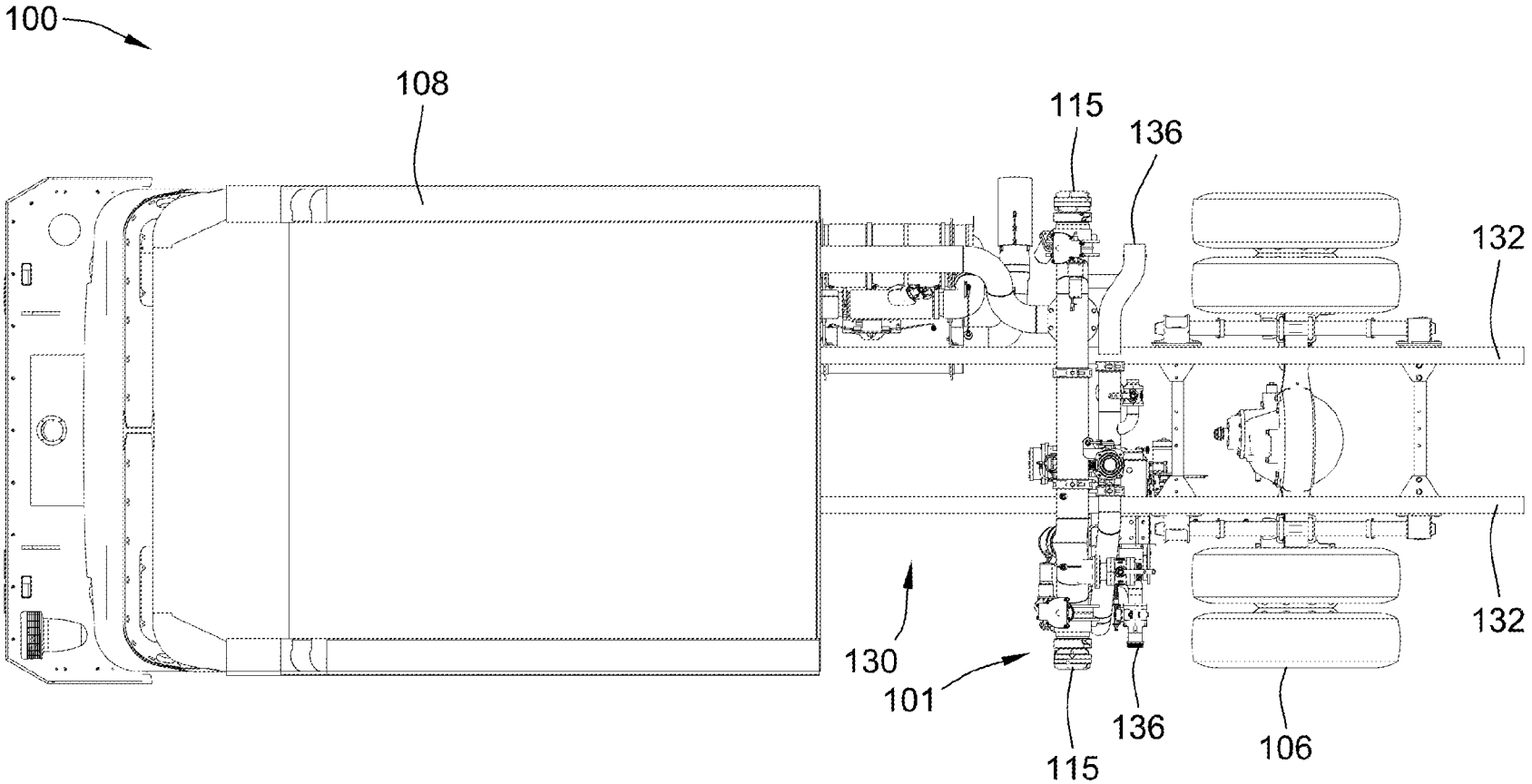
FIG. 5 is a top view of the pumper cab and chassis with a fire pump and accessory system of FIG. 3.
Figure 6:
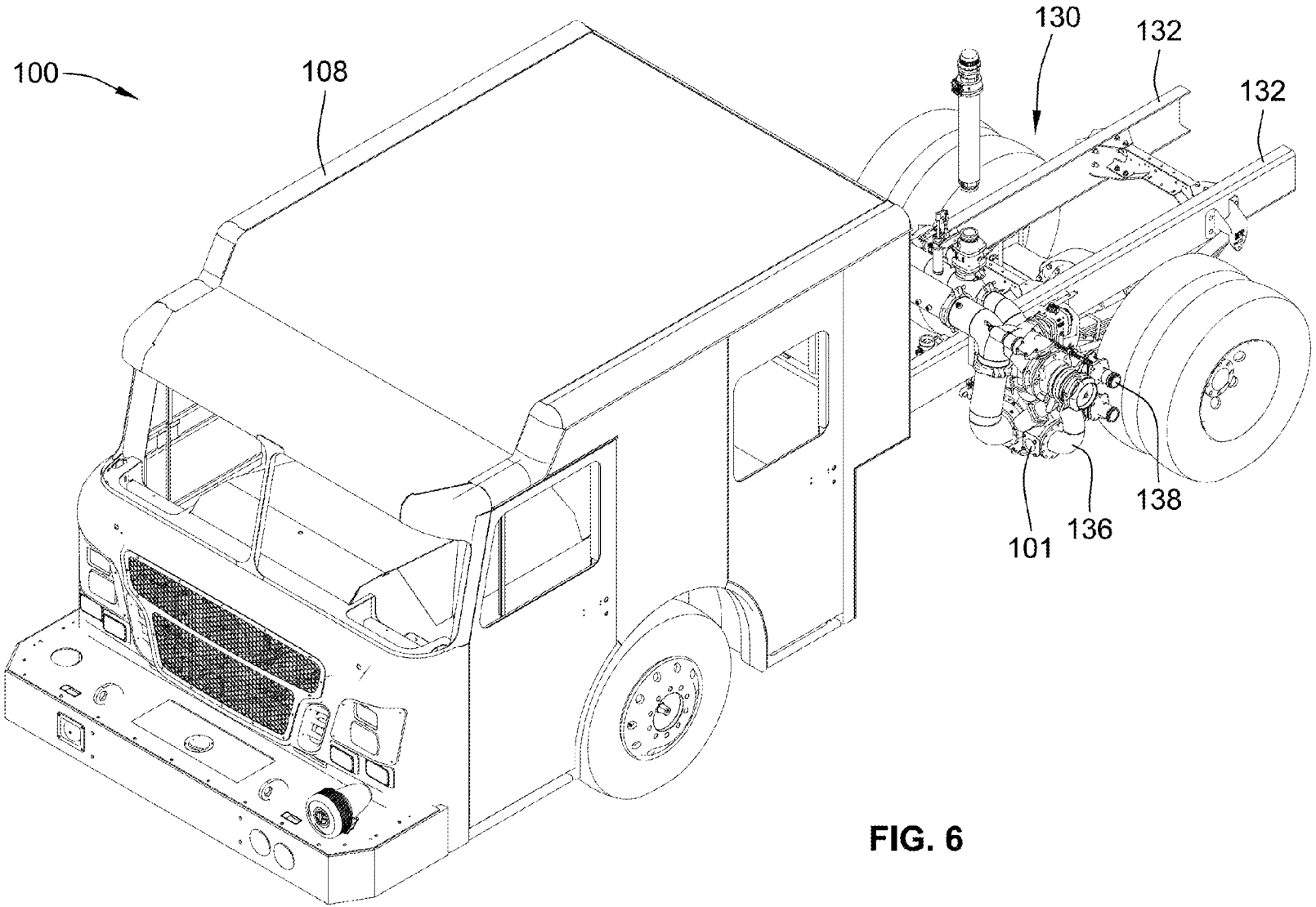
FIG. 6 is a pictorial view of the pumper cab and chassis with a fire pump and accessory system of FIG. 3.

The embodiment of FIG. 4 shows the fire pump and accessory system 101 located adjacent to the rear chassis suspension components 134 and primarily on the outside of one of the parallel rails 132. FIG. 5. is a top view of the pumper vehicle 100 and fire pump and accessory system 101 of FIG. 4. As can be seen from FIG. 5, an embodiment of the pumper vehicle 100 includes a suction inlet connection 115 and a pump discharge valve 136 on each side of the pumper vehicle 100. FIG. 6 is a pictorial view of the pumper vehicle 100 showing a pump discharge valve 136 and pump outlet connection 138 on one side of the pumper vehicle 100.

Figure 7:
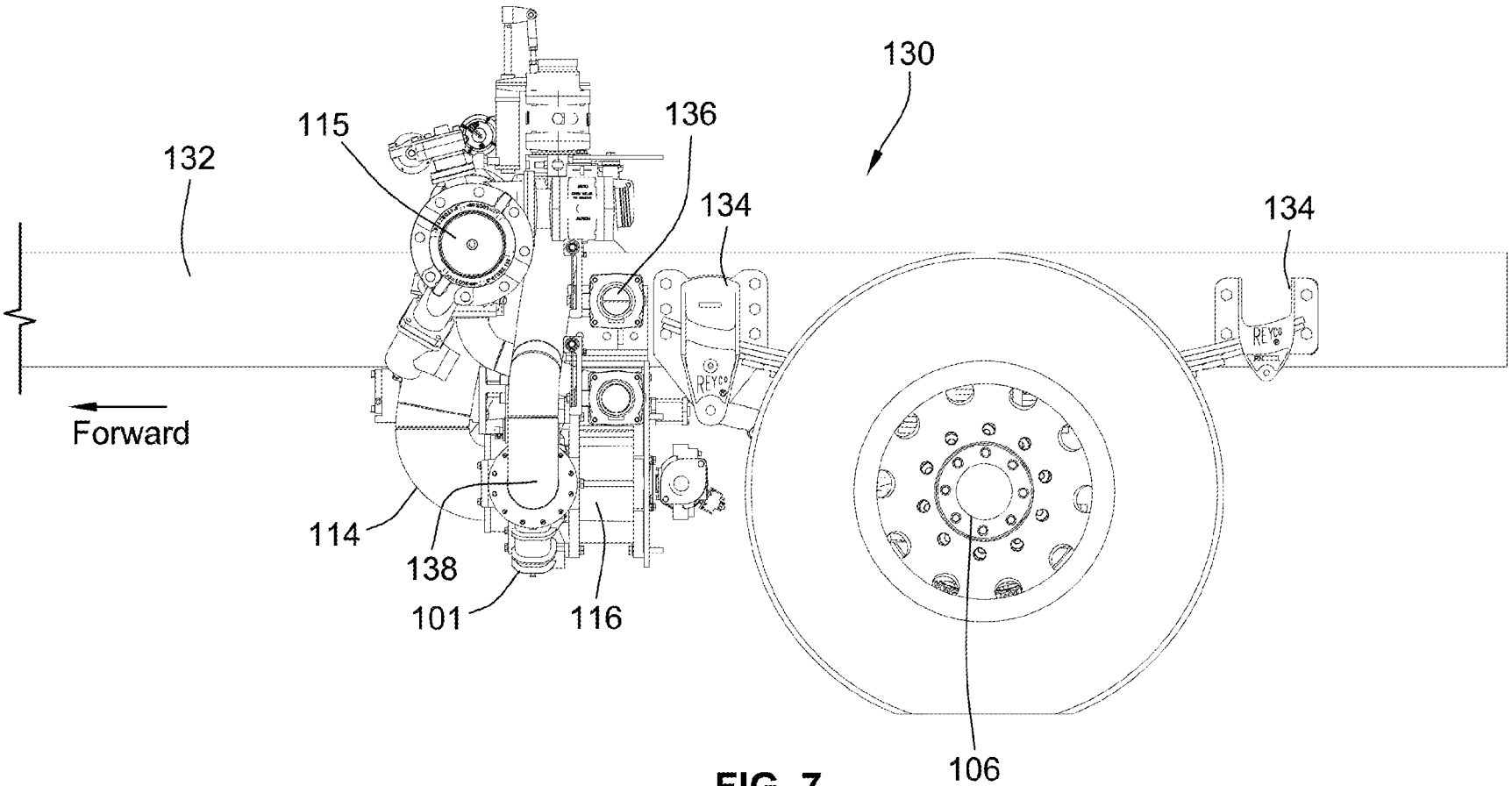
FIG. 7 is a close-up side view of the fire pump and accessory system shown adjacent to the rear chassis suspension system, constructed in accordance with an embodiment of the invention.
Figure 8:
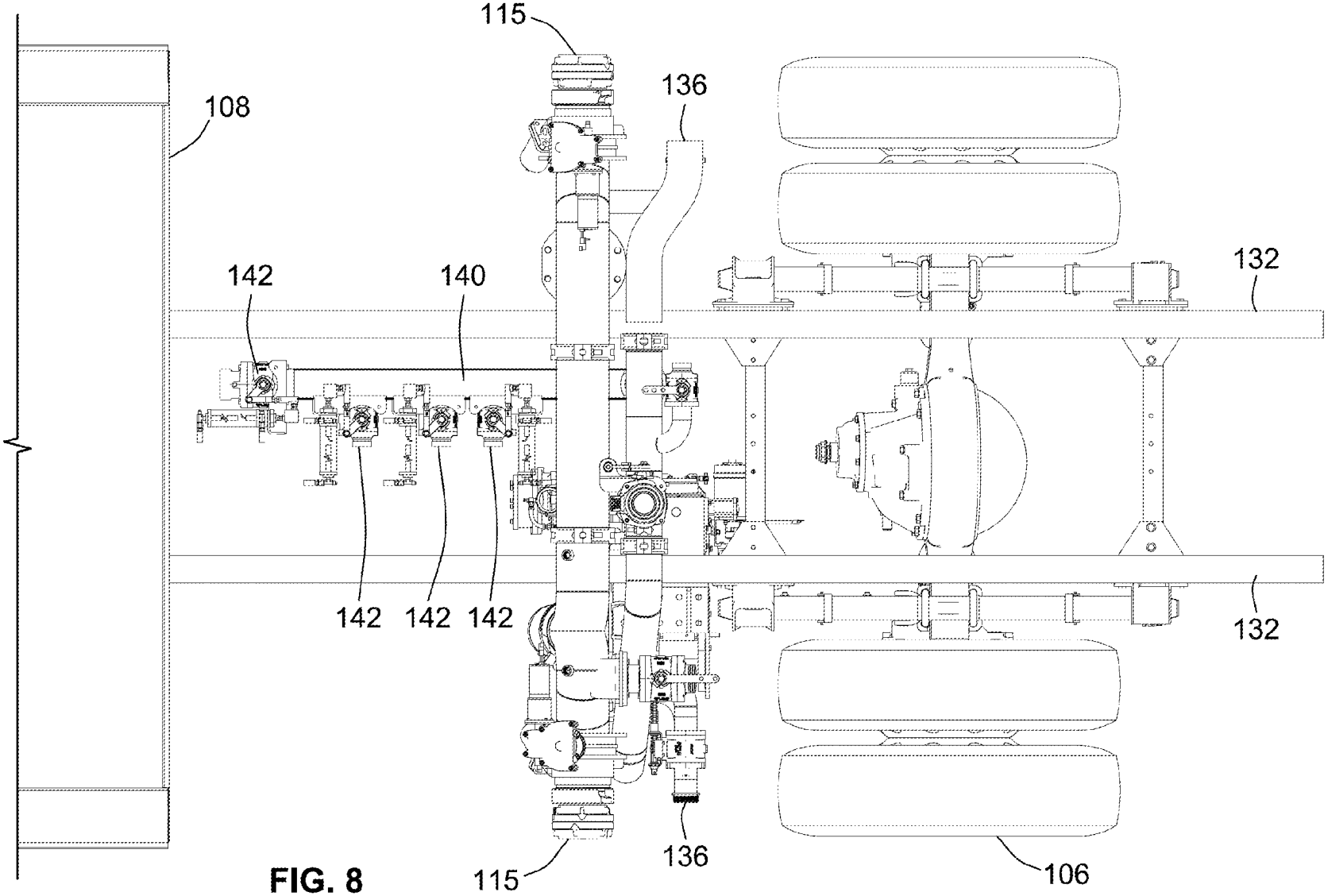
FIG. 8 is a top view of the fire pump and accessory system showing a discharge pipe and discharge valve, constructed in accordance with an embodiment of the invention.

FIGS. 7 and 8 are close-up side and top views, respectively, of the fire pump and accessory system 101 shown adjacent to the rear chassis suspension components 134, constructed in accordance with an embodiment of the invention. These close-up views show the proximity of the fire pump and accessory system 101 to the rear chassis suspension components 134 and rear wheel 106. FIGS. 7 and 8 also show the nesting of components of the fire pump and accessory system 101, and how the system is disposed within and without the parallel rails 132 of the chassis frame 130.

Referring again to FIG. 1, in embodiments of the invention, the improved pump location 104 also increases the amount of useable compartment space, thus allowing fire departments to carry more equipment with one pumper vehicle. A commonly-used 44-inch pump module that is mid-ship mounted occupies approximately 164 cubic feet of space. In embodiments of the invention, the size of a pump compartment 105 may be reduced significantly, for example to 34 cubic feet, thereby freeing up 130 cubic feet of additional space for equipment, etc. While pump compartments 105 can vary in size due to configuration, it should be noted that the described improved pump location 104 may increase the equipment-carrying capacity of the pumper vehicle 100 by varying amounts as well.

In an embodiment of the invention, rather than increasing the cargo-carrying capacity of the pumper, the wheelbase of the vehicle can be shortened due to the improved location 104 of the fire pump and accessory system 101. As stated above, traditional 44-inch pump modules are common in the industry. Due to the location 104 of the fire pump and accessory system 101 just forward of the rear wheel 106, in particular embodiments of the invention, the fire pump and accessory system 101 occupies only an additional 22.5 inches in length as compared to the full 44 inches, thus making it possible to reduce the wheelbase by 21.5 inches in some cases. The shorter wheelbase also results in a smaller turning radius and improved overall handling of the pumper vehicle 100. The ability to nest the plumbing components between the parallel rails 132 and other nest locations are additional features that make it possible to reduce vehicle length. While the nested plumbing components reduce the wheelbase, the amount of this reduction may vary based on the number of specified discharges included in the system.

Referring to FIG. 8, in at least one embodiment, the pumper vehicle 100 includes a pedestal-style fire pump and gear case that are driven from a single power take-off (PTO) port from the transmission location of the vehicle. In this embodiment, the fire pump and accessory system 101 is located such that the main suction manifolds or suction inlet connections 115 are disposed perpendicular to the parallel rails 132. Further, a discharge pipe 140 is located such that it is positioned in between the parallel rails 132 in an orientation substantially parallel to the parallel rails 132. In the embodiment shown the discharge pipe has a plurality of discharge valves 142 coupled to the discharge pipe 140 at respective discharge locations via hard pipe or flexible high-pressure line.

In conventional firefighting vehicles, valves have typically been controlled via the use of direct manual push/pull connection or by electrical actuation. Specifically, when a manual valve is used for a 2-inch valve versus a 4-inch valve, the force required to actuate the manual valve greatly increases. Thus, the system utilizes a hydraulically actuated valve controller and cylinder. Through the use of hydraulics, it is possible to significantly reduce the amount of force required to operate valves. The second benefit of the hydraulic actuation is that it allows for the location of the valve almost anywhere on the vehicle. Thus, it is possible to position valve locations for improved pump operation, easier maintenance, and better access. While the positioning of valves can be achieved via hydraulic control, it should be noted that, when practical, manual push/pull control or electric control may also be utilized where feasible and/or desired.

Typically, when PTO pumps and compressed-air foam system (CAFS) systems are used, the PTO ports on the transmission become much utilized, such that each system would require its own individual PTO port, thereby reducing the capabilities to add other PTO-applicable systems. Examples of other PTO-applicable systems may include, but are not limited to, a hydraulic generator or a rescue tool pump. In some embodiments of the invention such as that shown in FIG. 2, the fire pump and accessory system 101 is configured to allow the addition of a CAFS compressor 122 from the pump gear case 119, thereby not utilizing an additional PTO port, thus allowing such a PTO port to be used for a generator or other equipment options.

Based on the foregoing, it can be seen that improved integration of the fire pump with the vehicle results in increased compartment space, increased ramp break over angle, better layout options for the vehicle, along with improved vehicle performance. Performance improvements may be the result of a shorter wheelbase, and improved pump control, and ergonomically improved equipment placement, improved turning radius, maneuverability, etc.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fire-fighting pumper vehicle comprising:

a cab configured to transport a crew of firefighters;

a water tank disposed to the rear of the cab;

a chassis frame configured to support the cab, the water tank, and one or more fire pump systems disposed on the chassis proximate to, and forward of, the rear wheels;

wherein the fire pump system has nested components and includes a power take-off pump configured to operate from a gear case of the fire pump system, the fire pump system disposed in proximity to the rear wheel and rear chassis suspension system; and wherein the fire-fighting pumper is a Class A pumper, under NFPA 1901, and the fire pump system is disposed in a pump compartment that occupies less than 50 cubic feet.

2. The fire-fighting pumper vehicle of claim 1, wherein the fire pump system has a rated capacity of at least 750 gpm.

3. The fire-fighting pumper vehicle of claim 2, wherein the fire pump system has a rated capacity of approximately 1500 gpm.

4. The fire-fighting pumper vehicle of claim 1, wherein the chassis frame includes two substantially parallel frame rails, and the fire pump system includes one or more main suction manifolds disposed perpendicularly to the two substantially parallel frame rails.

5. The fire-fighting pumper vehicle of claim 4, wherein the fire pump includes one or more outlet discharge valves disposed on a discharge pipe that runs in between and substantially parallel to the two substantially parallel frame rails.

6. The fire-fighting pumper vehicle of claim 1, wherein the fire pump system is disposed in a pump compartment that occupies less than 35 cubic feet.

7. The fire-fighting pumper vehicle of claim 1, wherein the power take-off pump is configured to operate one of a water only system, water and foam only system, and a water and compressed-air foam system.

8. The fire-fighting pumper vehicle of claim 1, wherein the fire pump system includes a CAFS compressor.

9. The fire-fighting pumper vehicle of claim 1, wherein the fire pump system includes a pump primer motor.

10. A pumper vehicle comprising:

a chassis frame having two frame rails supporting a cab at a front end of the chassis frame, and a fire pump system at a rear end of the chassis frame;

a fire pump system comprising:

a suction inlet and a pump outlet;

a gear box coupled to a pump impeller;

a gear case drive yoke coupled to the gear box; and a drive output coupled to the gear case drive yoke;

wherein the fire pump system is located to the outside of one of the substantially parallel rails, and wherein the pumper vehicle is a Class A pumper, under NFPA 1901; and wherein the pump compartment housing the fire pump system is less than 40 cubic feet.

11. The pumper vehicle of claim 10, wherein the fire pump system further comprises a pump primer motor.

12. The pumper vehicle of claim 11, wherein the fire pump system further comprises a CAFS compressor.

13. The pumper vehicle of claim 10, wherein the fire pump system includes a fire pump configured to be driven by a power takeoff device.

14. The pumper vehicle of claim 10, wherein the fire pump system has a rated capacity greater than 750 gpm.

15. The pumper vehicle of claim 14, wherein the fire pump system has a rated capacity of approximately 1500 gpm.

16. The pumper vehicle of claim 10, wherein the fire pump system includes one or more suction inlet connections disposed perpendicularly to the two frame rails.

17. The pumper vehicle of claim 16, wherein the fire pump system includes a plurality of outlet discharge valves disposed on a discharge pipe that runs in between, and substantially parallel to at least one of the two frame rails.

18. The pumper vehicle of claim 10, wherein the fire pump system is configured to operate one of a water-only system, water-and-foam-only system, and a water-and-compressed-air foam system.

* * * * *